United States Patent [19]

Hertel

[11] 4,437,419

[45] Mar. 20, 1984

[54] INCINERATOR

[75] Inventor: Karl R. Hertel, Delafield, Wis.

[73] Assignee: Pyro-Gen Corp., Waukesha, Wis.

[21] Appl. No.: 421,608

[22] Filed: Sep. 22, 1982

[51] Int. Cl.[3] ..... F23G 3/00; F23G 5/00; F23G 7/00

[52] U.S. Cl. ..... 110/259; 110/165 R; 110/215; 110/216; 110/220; 110/246; 110/255; 110/302; 110/346; 209/139 R

[58] Field of Search ..... 110/246, 255, 259, 165 R, 110/302, 346, 215, 216, 342, 344, 235, 220; 209/139 R, 138, 140

[56] References Cited

U.S. PATENT DOCUMENTS

| | | | |
|---|---|---|---|
| 3,173,389 | 3/1965 | Cates, Jr. et al. | 110/255 |
| 3,259,085 | 7/1966 | Campbell . | |
| 3,646,898 | 3/1972 | Bavers . | |
| 3,719,171 | 3/1973 | Brooks | 110/255 |
| 3,768,554 | 10/1973 | Stahl . | |
| 3,794,565 | 2/1974 | Bielski et al. | 110/259 X |
| 3,906,874 | 9/1975 | Jaronko et al. | 110/255 |
| 4,229,694 | 11/1981 | Goodell | 209/139 R |

*Primary Examiner*—Edward G. Favors

*Attorney, Agent, or Firm*—Wheeler, House, Fuller & Hohenfeldt

[57] ABSTRACT

Apparatus and process for incinerating waste and reclaiming resources, particularly ferrous metals, galss, and aluminum, in separate output streams. The incinerator itself can use combustion draft air as a medium for separating lighter and heavier fractions of the burned material in the incinerator. The combustion zone of the incinerator is defined by a foraminated cylindrical wall which is rotated to distribute the incinerating materials and separate burned waste from the combustion zone.

The incinerator can be cooled by a eutectic liquid metal coolant. The use of this coolant allows the heat exhange surfaces of the incinerator to be quite thin for greater economy, as such fluids, particularly a eutectic mixture of sodium and potassium, do not vaporize at atmospheric pressure over a wide working temperature also disclosed, as is improved means for separating aluminum rich and glass rich fractions from the heavier fraction of burned waste separated in the incinerator.

35 Claims, 11 Drawing Figures

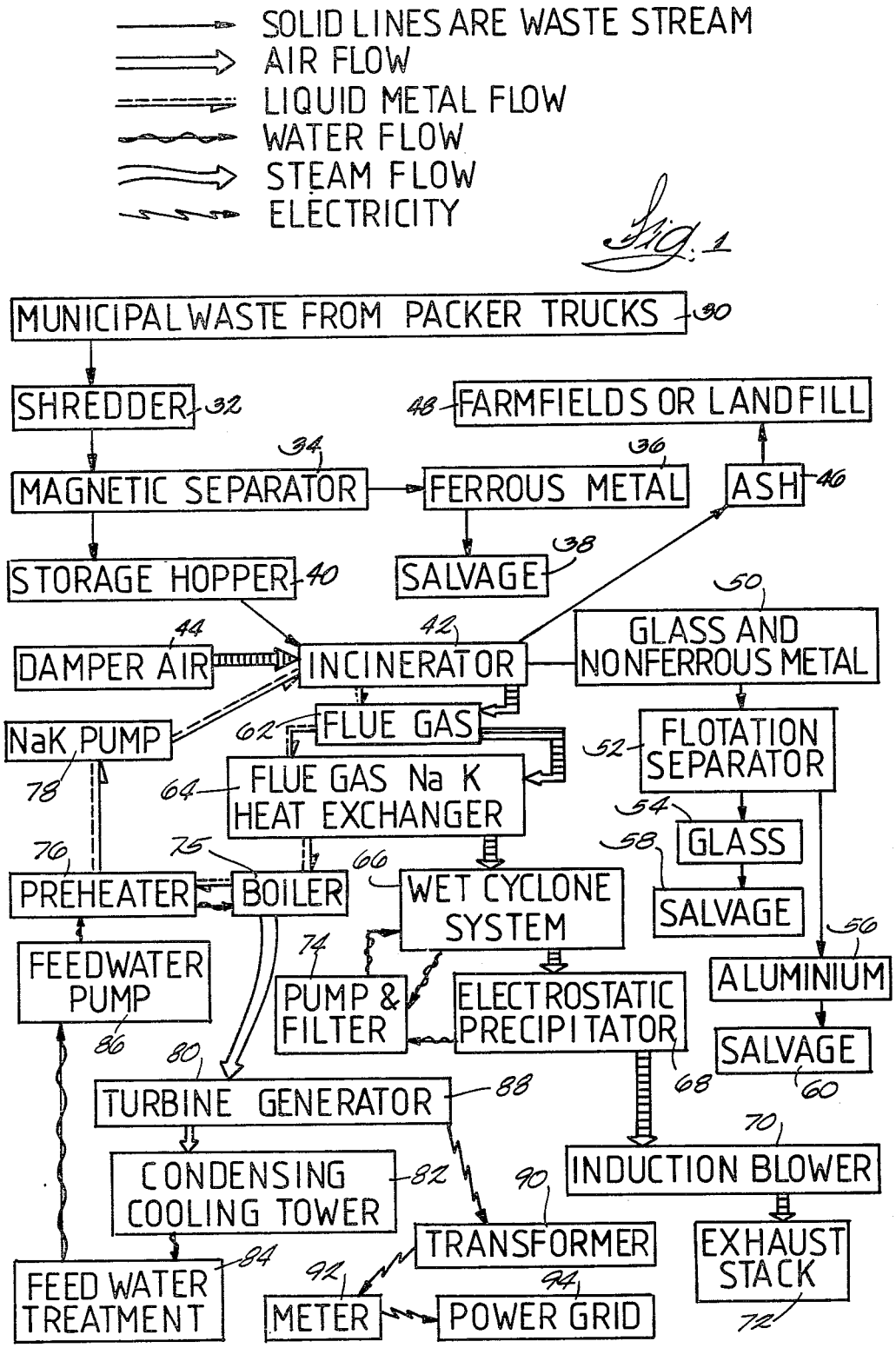
SOLID LINES ARE WASTE STREAM
AIR FLOW
LIQUID METAL FLOW
WATER FLOW
STEAM FLOW
ELECTRICITY
Fig. 1
MUNICIPAL WASTE FROM PACKER TRUCKS 30
SHREDDER 32
48 FARMFIELDS OR LANDFILL
34 MAGNETIC SEPARATOR
36 FERROUS METAL
ASH 46
STORAGE HOPPER 40
SALVAGE 38
50 GLASS AND NONFERROUS METAL
44 DAMPER AIR
42 INCINERATOR
NaK PUMP
62 FLUE GAS
52 FLOTATION SEPARATOR
78
64 FLUE GAS Na K HEAT EXCHANGER
54 GLASS
58 SALVAGE
76 PREHEATER
75 BOILER
66 WET CYCLONE SYSTEM
56 ALUMINIUM
FEEDWATER PUMP
74 PUMP & FILTER
ELECTROSTATIC PRECIPITATOR
SALVAGE
86
80 TURBINE GENERATOR 88
68
60
70 INDUCTION BLOWER
CONDENSING COOLING TOWER 82
90 TRANSFORMER
EXHAUST STACK
84 FEED WATER TREATMENT
92 METER
94 POWER GRID
72

INCINERATOR

TECHNICAL FIELD

The invention relates to waste incinerators and to means associated with incinerators for sorting out and reclaiming valuable resources such as ferrous metals, aluminum, and glass. The invention further relates to means for utilizing the heat from waste incineration to produce steam for power generation or other purposes, and still further to improved flue gas scrubbing equipment for incinerators.

BACKGROUND OF THE INVENTION

Waste incinerators are well known devices which support and confine waste as it is burned and then transport burned waste out of the combustion area for disposal.

U.S. Pat. No. 3,646,898, issued to Bavers on Mar. 7, 1982, shows such an incinerator including a horizontally disposed rotating cage for separating irreducible materials from fly ash. A flue chamber is provided for directing the flow of combustion air and flue gases through the incinerator. The Bavers device passes fly ash through the rotating screen and withdraws it from the bottom of the apparatus by suction. The Bavers device and process has several disadvantages. For example, Bavers does not make clear what the flow of draft air is, but apparently the flow is divided, as combustion gases are taught to exit via flue 24 and ash exits through sloping chute 28 and is drawn away by an exhaust blower 76. U.S. Pat. No. 3,259,085, issued to Campbell on July 5, 1966, also discloses an incinerator having a rotatable foraminated drum defining a combustion zone. These prior incinerators have not involved integrated means for separating lighter materials (predominantly fly ash) from heavier materials which are rich in recyclable resources such as aluminum and glass, nor have they shown how the heat of combustion might be reclaimed and used.

Turning to the use of an incinerator to fire a boiler, water has been heated to form steam by direct contact with an operating incinerator, but the incinerator of such a system requires heat exchange surfaces made of sufficiently heavy stock to withstand the relatively high pressure required to keep the water in a liquid state for efficient heat conduction. The heat exchange surfaces within an incinerator must also be able to withstand high temperatures and corrosion, particularly corrosion due to hydrogen chloride generated by the combustion of trash. Previous incinerating boiler designs have thus required thick heat exchange walls made of exotic metals which resist corrosion.

Although other heat transfer media for a primary coolant loop are known in other fields, particularly in the field of generating power from atomic energy (see for example U.S. Pat. No. 3,768,554, issued to Stahl on Oct. 30, 1973) the art has not made the modifications to this technology which would be necessary to suit it to a waste incinerator.

Looking now at the problem of flue gas disposal, electrostatic precipitators and water scrubbers have been used, respectively, to remove small and large particles from flue gases before releasing them, but such a system has not previously been particularly adapted for the problems of waste incineration.

All of these difficulties have hampered efficient utilization of waste as a source of energy and recyclable materials.

SUMMARY OF THE INVENTION

The objects of this invention are first, to provide an improved incinerator which will burn the combustible components or ordinary waste: second, to accomplish at least partial separation of recyclable materials from ash within an incinerator by utilizing draft air as a separating medium; third, to provide a continuous incineration and recycling process and apparatus; fourth, to provide improved means for separating glass rich and aluminum rich fractions from burned waste materials; fifth, to provide improved flue gas treatment means for incinerators; and sixth, to provide an incinerator which is suitable for providing heat to a boiler for electric power generation or other purposes. Other objects of the invention will become apparent from the description which follows.

A first aspect of the invention is incinerating apparatus comprising a flue chamber having inlets for draft air and unburned waste, a flue gas outlet, and a combustion zone between the draft air inlet and flue gas outlet. Support means disposed in the combustion zone—preferably an open-ended foraminated cylindrical cage having a horizontal or slightly downwardly tilted rotation axis, an input end, and an output end—supports waste in the combustion zone without obstructing the flow of draft air or flue gases. When the waste is burned, particulate and molten material drop through the foraminated wall and larger burned waste material is advanced along the foraminated wall and drops from the output end of the support means. In the preferred embodiment all the nongaseous burned waste leaving the support means is directed across the incoming combustion draft air, thereby separating it into a light fraction which is predominately fly ash and a heavy fraction which is rich in recyclable materials such as aluminum and glass. Separate conveying means can be disposed in the paths of the heavy and light fractions to independently convey the fractions out of the incinerator.

In a preferred embodiment of the invention, ash baffles deflect burned waste passing from the combustion zone toward an ash screw conveyor which transports the solid burned waste from the combustion zone while concentrating it into a compact stream which is more easily acted upon by the draft air. A portion of the lowermost wall of the incinerator can also be inclined toward the area beneath the draft air inlet for catching fly ash dispersed by the draft air and redirecting it into the light fraction.

To adapt the incinerator for heating a boiler, heat exchangers can be disposed within the walls of the incinerator, the ash baffles, or the flue as part of a primary loop for collecting incineration heat. The heat exchangers can substantially entirely surround the combustion zone because the ash baffles shield the draft air inlet and waste outlet from the combustion zone. The preferred heat exchangers utilize liquid metal, preferably a eutectic mixture of sodium and potassium, as the heat transfer medium. The advantage of this medium is that it remains a liquid during the entire heat exchange cycle, so there is no need to build the surfaces of the primary loop out of a material which can resist high vapor pressure. The liquid metal is then interfaced with a second heat transfer medium, typically water, in secondary heat exchange loop to produce steam for power generation and other purposes.

In another preferred embodiment of the invention, means are provided upstream of the incinerator for separating ferrous metals from waste prior to burning the waste as previously described to reclaim nonferrous metals and glass. Novel ferrous metal separating means are also disclosed.

Another feature of the invention is a flotation separator for separating glass and aluminum rich fractions from the heavy fraction conveyed from the incinerator. The heavy fraction is fed to the middle of a air flotation chamber in which the flow rate and other conditions are adjusted so that the aluminum-containing components migrate upward and the glass-containing components migrate downward. An aluminum rich fraction is then collected from the top of the separator, while a glass rich fraction is collected from the bottom of the separator.

Another aspect of the invention is separation means for treating the flue gases emitted from the incinerator. The separation apparatus includes spray means for wetting the effluent, a wet cyclone separator for passing the gaseous components of the flue gas and trapping its liquid and solid components, and a wet electrostatic precipitator for removing residual solids and liquids from the gaseous components of the flue gases.

The invention also includes processes for incinerating waste while recovering and separating its recyclable constituents.

BRIEF DESCRIPTION OF DRAWINGS

FIG. 1 is a schematic diagram of the process and apparatus for treating waste by burning its combustible portion; using the resulting heat for electric power generation; reclaiming glass, aluminum and ferrous metal portions; and treating the resulting flue gases; all according to the present invention.

DETAILED DESCRIPTION OF THE PREFERRED EMBODIMENTS

Figure 4:
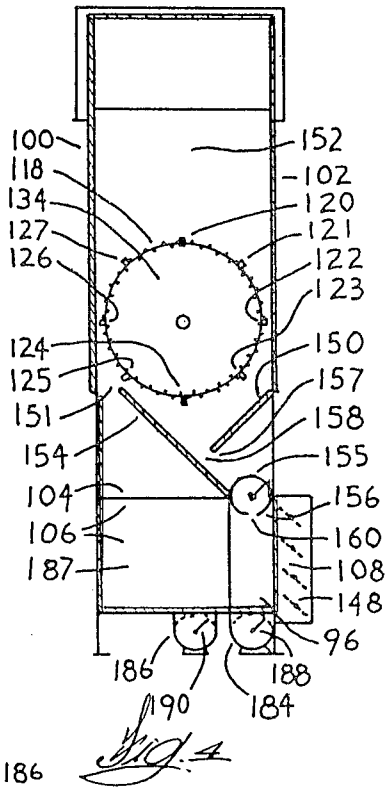
FIG. 4 is a vertical section taken along line 4—4 of FIG. 2.

Although the disclosure hereof is detailed and exact to enable those skilled in the art to practice the invention, the physical embodiments herein disclosed merely exemplify the invention, which may be embodied in other specific structure. While the best known embodiment has been described, the details may be changed without departing from the invention, which is defined by the claims.

Because studying the process invention first will aid one's understanding of the mechanical features of the invention, reference is first made to FIG. 1, showing the process flow. Box 30 represents municipal waste input, which is first transferred, as by a screw conveyor, to a shredder 32 where the waste is comminuted to a uniform size for even burning and better processing. The shredded waste is then conveyed, again preferably by a screw conveyor, to a magnetic separator 34 which separates a stream of ferrous metal 36 for salvage by further, well known means denoted as 38. The nonferrous stream from separator 34 is conveyed to a storage hopper 40 from which incinerator 42 is fed. Damper air from source 44, typically the atmosphere, passes into incinerator 42 to support combustion.

A first output 46 from incinerator 42 is provided for a light fraction consisting essentially of ash, which can be distributed to farm fields or landfill sites denoted by box 48. A second output stream from incinerator 42 is a heavy fraction consisting essentially of glass and nonferrous metals such as aluminum. This stream, represented by box 50, is passed through a flotation separator 52 which divides the stream into a glass rich fraction 54 and an aluminum rich fraction 56. These fractions are respectively salvaged from points 58 and 60. The third output from incinerator 42 is for flue gases, denoted as 62 and consisting essentially of nitrogen, water vapor, carbon dioxide, other combustion products, and some particulate matter.

The flue gases pass through heat exchanger 64, then through a wet cyclone system 66 in which the flue gases are mixed with a water spray and then liquids and entrained solids are separated from gases. The cyclone treated flue gases are then conveyed through an electrostatic precipitator 68, preferably a wet electrostatic precipitator for precipitating entrained fluid droplets as well as solid particles. The scrubbed gases are then conveyed by an induction blower 70 to a stack 72 from which the treated flue gases are vented to the atmosphere. The scrubber water from wet cyclone system 66 is also used in the operation of precipitator 68, and then is conveyed via a pump and filter 74 back to wet cyclone system 66, where it is again sprayed into the flue gases.

The system shown in FIG. 1 is adapted to extract heat from incinerator 42 for generation of electrical power. Incinerator 42 contains at least a flue gas heat exchanger 64, and preferably the incinerator walls also include heat exchange surfaces which are in circuit with the flue gas heat exchanger. The heat exchangers are part of a primary loop which also includes a boiler 75 and preheater 76 for transferring heat to a secondary loop and a pump 78 for circulating the heat transfer medium. In this embodiment the heat transfer medium in the primary loop is a eutectic mixture or alloy of sodium and potassium metals.

The secondary loop circulates water through pre-heater 76 and boiler 75 in heat exchange relation to the primary loop, producing pressurized, heated water or steam. Boiler 75 can feed any device which requires a feed of pressurized heated water or steam, such as steam turbine 80, then the condensate is cooled in cooling tower 82, recovered and replenished at a water treatment station 84, and recycled by pump 86 to pre-heater 76, thus completing the secondary loop. Turbine 80 is here shown driving an electric power generator 88, connected via the usual transformer 90 and meter 92 to the power grid 94. Electric power from generator 88 can also be used for operating equipment connected with the incinerator system.

Figure 2:
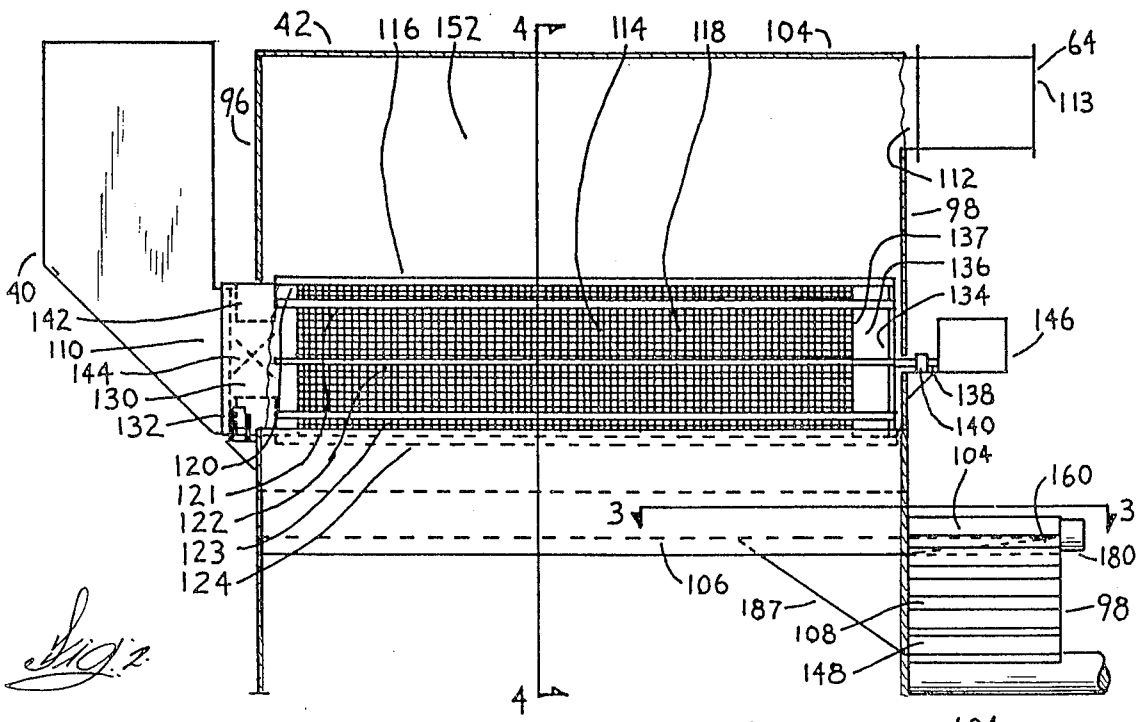
FIG. 2 is a vertical elevational view of an incinerator according to the present invention, with side coolant walls removed.
Figure 3:
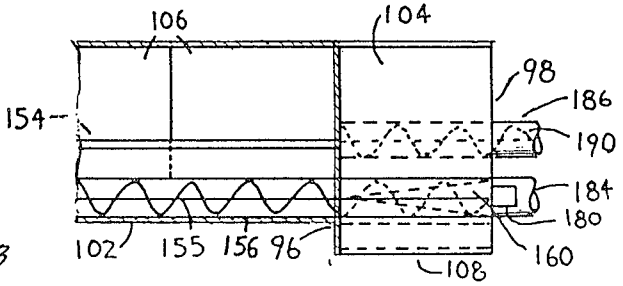
FIG. 3 is a partial horizontal section taken along line 3—3 of FIG. 2.

FIGS. 2 and 3 show the preferred incinerator means in more detail. Incinerator 42 comprises front and rear walls 96 and 98, side walls 100 and 102, a top wall 104, and a bottom wall 106 which together define a substantially closed flue chamber having a draft air inlet 108, a waste inlet 110 leading out of storage hopper 40, a flue gas outlet 112, leading into heat exchanger 113, and a combustion zone 114 between draft air inlet 108 and flue gas outlet 112. Support means 116 are provided for receiving and maintaining unburned waste in combustion zone 114. Support means 116 here comprises a rotating open-ended cage having a cylindrical, foraminated side wall 118 for supporting unburned waste, the foramina of which are small enough to retain the waste as delivered from hopper 40 but large enough to pass burned waste once it has been reduced in size or liquefied. Side wall 118 is supported by a framework of axially disposed members such as 120, 121, 122, 123, 124, 125, 126, and 127, each joined at its respective ends to an inlet ring 130 rotatably supported by roller bearings 132 and end hub and outlet ring 134. An open drop space 136 is framed by the axially disposed members and the space between the edge 137 of side wall 118 and end hub and outlet ring 134. An axially disposed stem 138 is secured by welded insertion to end hub 134 and is received and supported in a bearing 140. Bearings 132 and 140 are located outside walls 96 and 98 to protect them from the high temperature of the operating incinerator. In this embodiment infeed vanes such as 142 and 144 disposed within inlet ring 130 attack the waste material within hopper 40 as cage 116 is rotated by a motor, schematically shown as 146, which is disposed outside the confines of the flue chamber. The rate of rotation can be varied to account for differences in the composition of the waste, but for typical municipal trash should be about one revolution per minute. Cage 116 can be inclined downwardly at an angle of about 5 degrees below horizontal if desired, both to assist feeding and to distribute burned and unburned material during combustion. As a result of combustion, all carbonaceous materials are consumed to form carbon dioxide, water, and ash, glass materials are fractured and to some extent melted to form slag, and aluminum materials tend also to form a heavy slag. Any materials not able to escape through foraminated side wall 118 are advanced (by the infeed of unburned material) to drop space 136 and fall from the combustion zone.

Looking now at the manner in which draft air passes into and through the system, air drawn into incinerator 42 via draft air inlet 108 is regulated by a connected series of vanes 148, flows inward and upward along the inclined portion of bottom wall 106 and past a side edge of ash baffle 154 via opening 151, and enters combustion zone 114. Opening 151 directs the draft air directly at the burning waste, increasing turbulence in the combustion zone and the efficiency of combustion. Support means 116 is arranged so essentially all draft air must pass through it. The flue gases formed in combustion zone 114, as well as nitrogen and other nonparticipating constituents of the draft air, form flue gases which collect in headspace 152 before being vented through flue gas outlet 112 to a flue gas heat exchanger 113 shown in profile.

Returning now to the disposition of the solid products of combustion, the slag, ash, and other unburnable matter escaping through foraminated side wall 118 or drop space 136 drops to ash baffles 150 and 154 which act as burned waste conveying means. Ash baffles 150 and 154 are disposed within incinerator 42 beneath support means 116 and are inclined inwardly and downwardly (about 45 degrees below horizontal in this embodiment) toward an ash screw 155 disposed in a trough 156. The lower edge 157 of ash baffle 150 is spaced from ash baffle 154 to define an ash drop passage 158 for feeding burned waste from the lower edge of ash pan 150. Ash screw 155 fits closely within trough 156 to limit the counterflow of draft air.

Burned waste is fed along trough 156 and through slot 160 by rotation of screw 155 to intersect with the draft air drawn through opening 108. Slot 160 is tapered outward in the direction of feeding, so ash falls through first and larger particles and pieces are conveyed further to the right (FIGS. 2 and 3) before passing through slot 160. Heavier material contacted by the draft air is affected only slightly, and drops substantially straight down into a trough 184 disposed at the foot of draft air inlet 108. The material collected in trough 184 is a heavy fraction, rich in aluminum and glass. Lighter materials are carried by the incoming draft air past trough 184 to trough 186 or beyond. A portion 187 of bottom wall 106 inclined at a substantial angle (35 degress below horizontal) receives a portion of the light fraction carried by the incoming draft air and redirects it toward trough 186. Although some very finely divided material will remain in the flue gases, most of the light fraction—primarily fly ash—will gravitate toward trough 186. A screw conveyor 188 conveys the heavier fraction out of the incinerator for further separation such as the flotation separation to be described, while ash disposed in trough 186 is conveyed away independently by screw conveyor 190. Thus, unlike in prior art devices, separation of ash from reclaimable components of the burned waste is achieved directly in the incinerator, employing the draft air drawn into the incinerator by induction as a separating medium.

Looking now at the materials used in incinerator 42, the portions of the incinerator exposed to heat, particularly the foraminated side wall 118, other portions of support means 116, walls 96 through 106, and baffles 150 and 154 are made of heat resistant metal. A preferred material, which is resistant both to hydrogen chloride corrosion and to heat, is an alloy consisting essentially of about 16 percent chromium, about 7 percent iron, and about 77 percent nickel. One such material is known commercially as Inconel 600.

In the preferred embodiment of the invention, heat exchange means are provided for the stationary heated surfaces of the incinerator, such as ash baffles 150 and 154 and the incinerator walls, which are normally exposed to the radiant heat energy of combustion or in contact with flue gases, for extracting heat from the incinerator. For example, each wall to be provided with heat exchange means can be a double sheet joined together and hydrostatically expanded to define a labrynthine flow passage for conveying a heat transfer medium.

The preferred heat transfer medium is a eutectic alloy of sodium and potassium comprising about 40 percent potassium and 60 percent sodium. This eutectic mixture or alloy has an operating temperature of roughly 1000 degrees Fahrenheit, and is liquid under normal conditions between about 67 degrees Fahrenheit and roughly 1500 degrees Fahrenheit. Although it has a lower heat capacity than water, this alloy has a higher heat capacity than most high boiling fluids and its wide range of operating temperatures allows it to carry a substantial heat load without increasing its vapor pressure to as much as atmospheric pressure. The walls of the incinerator heat exchanger surfaces can thus be quite thin, requiring less of the relatively expensive high temperature alloy from which they are fabricated.

Figure 5:
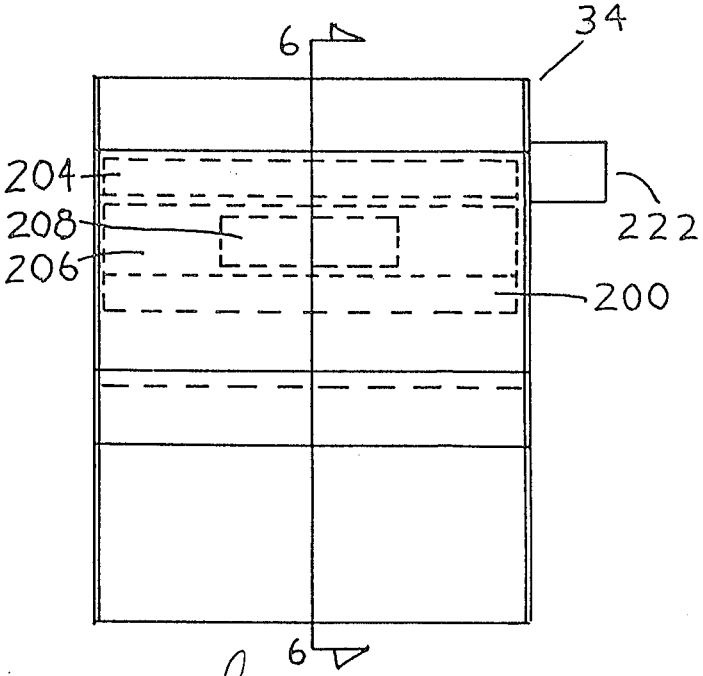
FIG. 5 is a front elevational view of a ferrous metal separator for treating a waste stream before it enters the incinerator shown in previous figures. Internal parts are shown in phantom.
Figure 6:
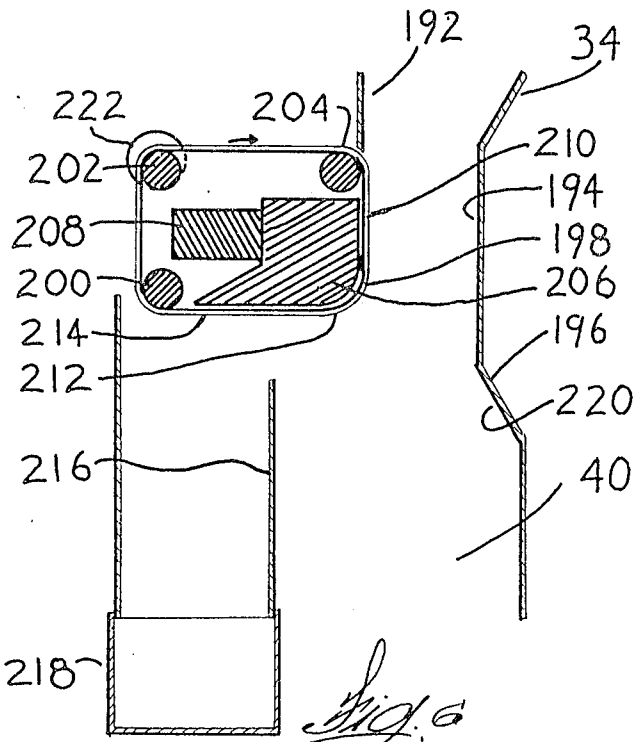
FIG. 6 is a schematic cross-sectional view of the structure shown in FIG. 5.

Although magnetic separators 34 shown in FIG. 1 are known to the art, a particularly preferred magnetic separator for use herein is shown in schematic form in FIGS. 5 and 6. Separator 34 has an inlet 192 fed from shredder 32 via a suitable conveyor. Inlet 192 is reduced to form a restricted throat 194 bounded on one side by a fixed wall 196 and on the other side by an endless belt 198 carried by rollers 200, 202, 204 and disposed in sliding contact with a block 206 which is magnetized by an electromagnet 208, thereby creating a substantial magnetic field directly adjacent to belt 198.

In this embodiment of the invention, the passage through throat 194 is arranged to be substantially vertical to define (gravitational) means for conveying a stream of waste along a path. Belt 198 has a first run 210 disposed parallel to and moving at the same velocity as waste traveling through the device. Ferrous materials are attracted by block 206 and held against first run 210. A second run 212 of belt 198 diverges from the path through throat 194, but at least a part of second run 212 is adjacent block 206 for transporting ferrous metal objects obliquely from the path through throat 194. The leftward extremity 214 of block 206 is located over the lip of conduit 216. Ferrous material conveyed past leftward extremity 214 escapes the magnetic field and drops through conduit 216 to a hopper 218 for recycling. Nonmagnetic material is not diverted by the magnetic means, and thus drops through an expansion zone 220 into storage hopper 40 as previously described. The travel of belt 198 is effected by drive roller 202, which is driven by a motor 222. The magnetic separator shown in FIGS. 4 and 5 works best if the material being treated is previously shredded, and a commercially available shredder which will comminute the material into 4 inch pieces is a model 42D shredder sold by The Heil Co., 3000 West Montana Street, Milwaukee, Wis.

Figure 8:
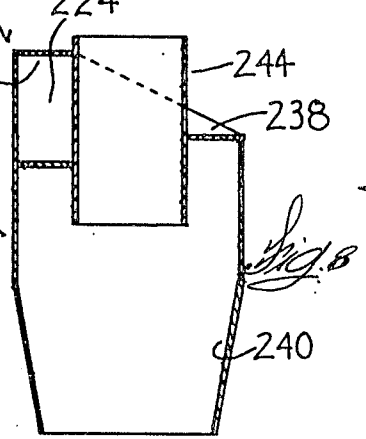
FIG. 8 is an axial cross-sectional view of the structure shown in FIG. 7.
Figure 9:
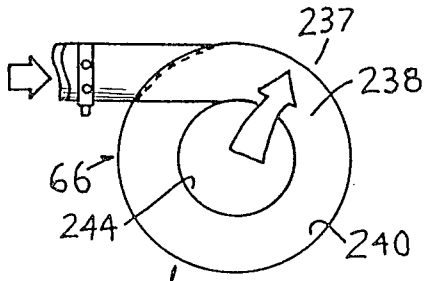
FIG. 9 is a top plan view of the structure shown in FIG. 7.
Figure 7:
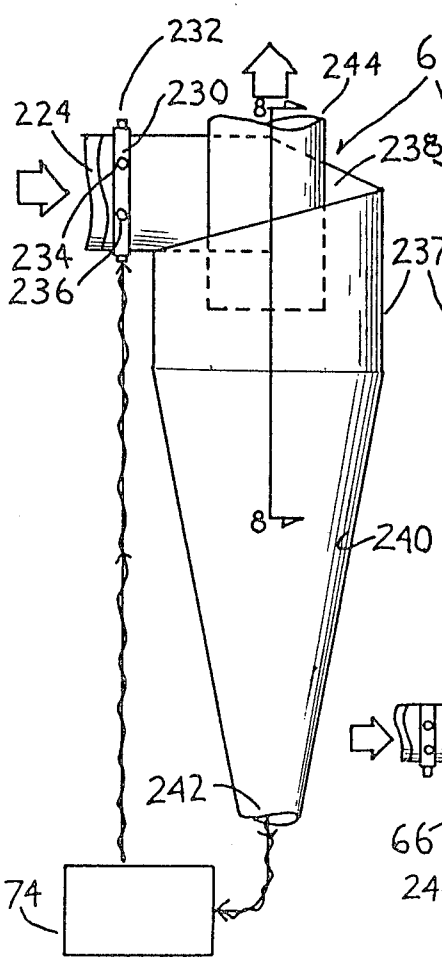
FIG. 7 is a side elevational view of a wet cyclone scrubber for use in connection with the present invention.

Turning now to the flue gas treatment means, FIGS. 7, 8, and 9 show the mechanical elements of wet cyclone system 66. Inlet 224 of cyclone system 66 forming a first part of the scrubber system receives effluent from flue gas outlet 112 or from a heat exchanger in circuit therewith. A ring shaped manifold 230 is supplied with a mildly alkaline water-based liquor by pump and filter 74 to feed spray heads such as 232, 234, and 236, forming a substantially continuous fluid curtain through which the flue gases flow. For a system in which 16,000 pounds of flue gas per hour are scrubbed, the scrubber liquor can be introduced at the rate of about 24 gallons per minute. The liquor absorbs noxious gases such as hydrogen chloride, soaks the fly ash, and thus entrains or dissolves these components in liquid droplets.

The sprayed flue gases then enter cyclone 237. Cyclone 237 has a helical top ring 238 defining a correspondingly shaped passed which receives the effluent, directing it along the conical inner wall 240 of the cyclone. Wall 240 can be made of coated Fiberglas or coated carbon steel. Large particles and droplets (having a diameter exceeding about 160 microns) lose velocity, slide downward along wall 240, and ultimately exit at the liquid outlet 242 of wall 240, while effluent gases are able to leave the cyclone by rising through outlet conduit 244. The effluent from liquid outlet 242 of cyclone 237 is treated, replenished as necessary with makeup water, filtered to remove particulate matter, and returned to manifold 230 to treat another portion of the effluent.

The gaseous component leaving cyclone 237 is directed into a wet electrostatic precipitator 68, which can be the Basic model precipitator commercially available from Fiber-Dyne Company, 8530 San Fernando Road, Sun Valley, Calif. 91352.

Figure 10:
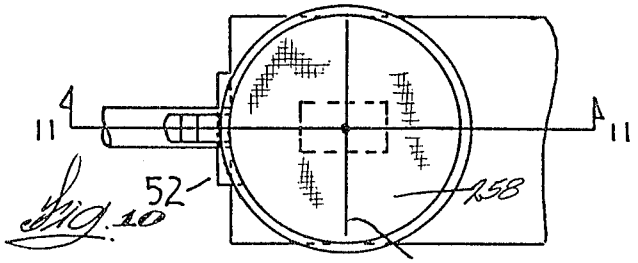
FIG. 10 is a top plan view of a flotation separation device for separating aluminum-rich and glass-rich fractions from a stream of material containing those components.
Figure 11:
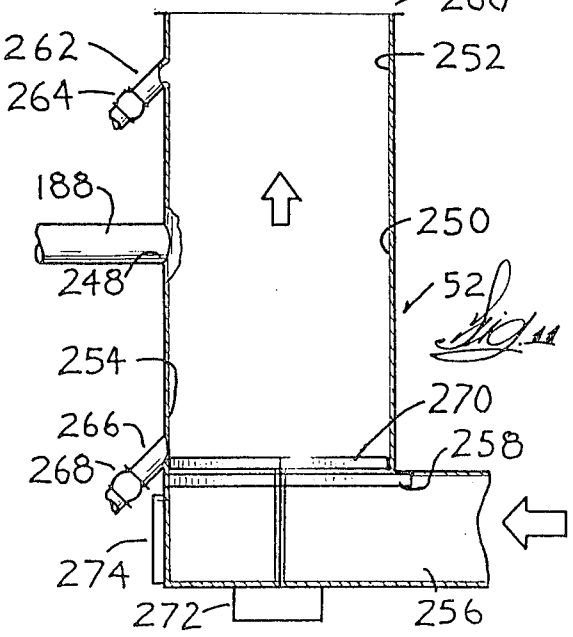
FIG. 11 is a vertical cross-sectional view, taken along line 11—11, of the structure shown in FIG. 10.

FIGS. 10 and 11 show a flotation separator for separating the heavy fraction taken from trough 184 into a first fraction which consists essentially of glass and a second fraction which consists essentially of aluminum. The separation depends on the difference in specific gravity between aluminum slag and glass slag, the former being lighter than the latter.

FIG. 11 shows the downstream end of screw conveyor 188 conveying the heavy fraction from incinerator 42 to an inlet 248 in the side wall 250 of flotation separator 52. Inlet 248 is located roughly midway between the upper end 252 and lower end 254 of separator 52. The charge of material in separator 52 is acted upon by a stream of fluidizing air supplied from an inlet conduit 256 at the rate of roughly 4000 cubic feet per minute for a flotation separator having a diameter of about 2 feet. Air from inlet conduit 256 passes through a steel support screen 258. Due to the action of this fluidizing air, the material within wall 250 is fluidized and agitated, thereby allowing it to sort itself according to density, the lighter materials rich in aluminum tending to migrate to upper end 252, and the heavier glass-rich fractions tending to gravitate downwardly toward lower end 254. Air passes upward through cylindrical wall 250 and out through the top 260 of the device. The aluminum rich fraction is drawn off by outlet conduit 262 which is equipped with a rotary air lock feeder 264. A second outlet conduit 266 is provided for conducting away the glass heavy fraction, and also includes a rotary air lock feeder 268 as previously described for preventing fluidizing air from escaping via this route.

To assist in removing the heavier fraction from the separator, a rotating sweeper blade 270 is provided to sweep screen 258, thereby moving the heaviest particles toward outlet conduit 266. Sweeper 270 is powered by a motor and gear drive 272. Since the device shown in FIGS. 10 and 11 can be expected to occasionally entrap very small, heavy particles which can fall through screen 258, a clean out door 274 is provided for permitting the convenient removal of such very dense materials when the device is not in operation. Conduits 266 and 262 respectively feed salvage hoppers 60 and 58 shown in FIG. 1.

I claim:

1. A waste incinerating and resource reclaiming device, comprising:

A. a substantially closed flue chamber having walls, a draft air inlet, a waste inlet, a flue gas outlet, and a combustion zone between said draft air inlet and said flue gas outlet;

B. support means for receiving and maintaining unburned waste in said combustion zone;

C. burned waste conveying means for feeding burned waste from said combustion zone to a position above said draft air inlet, so that air drawn through said draft air inlet separates said burned waste into heavy and light fractions as said waste drops from said position; and D. first and second conveyor means, respectively disposed in the paths of said heavy and light fractions, for separately conveying said heavy and light fractions from said flue chamber.

2. The device of claim 1, wherein said support means comprises a rotating cage having a cylindrical, foraminated sidewall for supporting said unburned waste and passing said burned waste and an open end for receiving unburned waste from said waste inlet.

3. The device of claim 2, wherein said cage rotates at the rate of about one revolution per minute.

4. The device of claim 2, further comprising infeed vanes disposed at said open end for feeding unburned waste into said cage.

5. The device of claim 1, wherein said burned waste conveying means includes at least one ash baffle disposed within said flue chamber beneath said support means and inclined downwardly beneath the support means.

6. The device of claim 5, wherein said at least one ash baffle comprises first and second ash baffles inclined about 45 degrees below horizontal in opposite directions.

7. The device of claim 6, wherein said first ash baffle has an upper edge spaced from a wall of said flue chamber to define a first passage through which air entering said draft air inlet is constrained to flow to reach said combustion zone and said second ash baffle has a lower edge spaced from said first ash baffle to define an ash drop passage between them.

8. The device of claim 7, wherein said burned waste conveying means further includes a screw conveyor feeder disposed beneath and fed by said ash baffles and including a tapered slot for feeding burned waste from said ash baffles above said draft air opening.

9. The device of claim 5, wherein at least one of said ash baffles, the walls of said flue chamber, and said flue gas outlet includes internal heat exchange means for transferring combustion heat from said incinerator to a heat transfer fluid.

10. The device of claim 9, further comprising external heat exchange means in circuit with said internal heat exchange means for withdrawing heat from said heat transfer fluid.

11. The device of claim 10, wherein said external heat exchange means constitutes a steam boiler.

12. The device of claim 9, wherein said heat transfer fluid comprises a eutectic alloy of sodium and potassium.

13. The device of claim 1, wherein at least a portion of the lowermost wall of said flue chamber is downwardly inclined toward said draft air inlet and said second conveyor means is disposed at the foot of said portion of the lowermost wall and beneath said draft air inlet.

14. The device of claim 13, wherein said portion of the lowermost wall is disposed at about 35 degrees below horizontal.

15. The device of claim 1, further comprising sorting means upstream of said waste inlet for removing ferrous metals from said waste prior to incineration.

16. The device of claim 15, wherein said sorting means comprises means for conveying a stream of waste along a path; an endless driven belt having a first run disposed to travel beside said path and a second run diverging from said path; magnetic means backing up said first run for diverting ferrous metal objects from said path into contact with said belt; and means disposed beneath at least a portion of said second run for collecting said ferrous metal objects as they drop from said belt.

17. The device of claim 15, further comprising waste shredding means upstream of said sorting means for comminuting said waste.

18. The device of claim 1, wherein said flue chamber walls are composed of a material which is resistant to hydrogen chloride and to heat.

19. The device of claim 18, wherein said material is an alloy consisting essentially of about 16 percent chromium, about 7 percent iron, and about 77 percent nickel.

20. The device of claim 1, further comprising a fluid bed separator fed by said first conveyor means for separating said heavy fraction into an aluminum-rich floating fraction and a glass-rich sinking fraction.

21. The device of claim 1, including a scrubber downstream of said flue gas outlet, said scrubber comprising:

A. spray means for wetting the effluent from said flue gas outlet;

B. wet cyclone separator means downstream from said spray means for trapping the liquid and solid components and passing the gaseous components of said effluent through a gas outlet; and C. a wet electrostatic precipitator downstream of said gas outlet for removing residual solids and liquids from said gaseous components.

22. A process for separating glass-rich and aluminum-rich fractions from waste, comprising the steps of:

A. incinerating waste containing at least one material selected from aluminum and glass in the combustion zone of an incinerator having a draft air inlet to form burned waste;

B. conveying said burned waste so that it drops downwardly through air passing from said air inlet to separate said burned waste into a light fraction consisting primarily of fly ash and a heavy fraction rich in at least one material selected from glass and aluminum; and C. conveying said heavy fraction out of said incinerator.

23. The process of claim 22, further comprising the preliminary step of separating ferrous metals from said waste.

24. The process of claim 22, further comprising the subsequent step of separating said heavy fraction into independent glass-rich and aluminum-rich fractions.

25. A process for incinerating waste and reclaiming resources, comprising the steps of:

A. providing incinerator means including a draft air inlet, a combustion chamber, and a flue gas outlet;

B. burning said waste in said combustion chamber, thereby producing burned waste and flue gases;

C. conveying said burned waste so that it drops downwardly through air passing from said inlet to separate it into lighter and heavier fractions; and D. conveying said heavier fraction to resource recycling means.

26. The process of claim 25, further comprising the preliminary step of separating ferrous metals from said waste.

27. The process of claim 26 still further comprising the preliminary step of comminuting said waste.

28. The process of claim 25, further comprising the subsequent step of flotation separating said heavier fraction into a glass-containing fraction and an aluminum-containing fraction.

29. The process of claim 25, further comprising the steps of:

A. passing said flue gases from said flue gas outlet;

B. wetting said flue gases;

C. passing said wetted gases through a wet cyclone separator for removing nongaseous components thereof;

D. passing said gases through an electrostatic precipitator for removing residual particulate matter; and E. venting the treated gases to the atmosphere.

30. The process of claim 25, further comprising the step of circulating a liquid heat transfer medium in association with said incinerator for extracting useful heat from burning said waste.

31. The process of claim 30, wherein said liquid heat transfer medium has a vapor pressure, over its working temperature range, which is less than atmospheric pressure.

32. The process of claim 31, wherein said liquid heat transfer medium is a eutectic mixture of sodium and potassium.

33. A waste incinerating device, comprising:

A. a substantially closed flue chamber having walls, a draft air inlet, a waste inlet, a burned waste outlet, a flue gas outlet, and a combustion zone;

B. support means for receiving and maintaining unburned waste in said combustion zone;

C. ash baffles disposed beneath said combustion zone for receiving burned waste from said support means and deflecting said burned waste to said burned waste outlet while shielding said combustion zone from said burned waste outlet; and D. heat transfer means associated with said flue chamber walls and ash baffles and substantially entirely surrounding said support means for collecting the radiant heat of combustion emitted from said combustion zone.

34. The waste incinerating device of claim 33, wherein said support means comprises a rotating cage having a cylindrical, foraminated wall for supporting unburned waste and passing burned waste.

35. The waste incinerating device of claim 34, wherein said cage includes a first open end for receiving unburned waste from said waste inlet, a second open end for passing burned waste which is unable to pass through said foraminated wall, and means for continuously feeding said unburned waste into said first open end.

* * * * *